US008867778B2

(12) United States Patent
Yang

(10) Patent No.: US 8,867,778 B2
(45) Date of Patent: Oct. 21, 2014

(54) LOUDSPEAKER

(71) Applicants: FirstChair Acoustics Co., Ltd., Taipei (TW); Ching-Wen Yang, Taipei (TW)

(72) Inventor: Ching-Wen Yang, Taipei (TW)

(73) Assignees: FirstChair Acoustics Co., Ltd., Taipei (TW); Ching-Wen Yang, Taipei (TW)

( * ) Notice: Subject to any disclaimer, the term of this patent is extended or adjusted under 35 U.S.C. 154(b) by 0 days.

(21) Appl. No.: 13/796,613

(22) Filed: Mar. 12, 2013

(65) Prior Publication Data

US 2014/0133691 A1 May 15, 2014

(30) Foreign Application Priority Data

Nov. 13, 2012 (TW) ..... 101221911 U

(51) Int. Cl.
*H04R 9/04* (2006.01)
*H04R 1/00* (2006.01)

(52) U.S. Cl.
CPC ..... *H04R 1/00* (2013.01)
USPC ..... 381/405; 381/398; 381/420; 181/171

(58) Field of Classification Search
CPC ..... H04R 7/24; H04R 9/06; H04R 9/025
USPC ..... 381/398, 400, 405, 407, 420; 181/171
See application file for complete search history.

(56) References Cited

U.S. PATENT DOCUMENTS

| | | | | |
|---|---|---|---|---|
| 3,665,124 | A * | 5/1972 | Sotome | 381/401 |
| 4,239,943 | A * | 12/1980 | Czerwinski | 381/404 |
| 5,739,480 | A * | 4/1998 | Lin | 181/144 |
| 5,848,174 | A * | 12/1998 | Ki et al. | 381/404 |
| 6,173,065 | B1 * | 1/2001 | Lin | 381/398 |
| 7,025,170 | B2 * | 4/2006 | Lin | 181/171 |
| 7,185,735 | B2 * | 3/2007 | Sahyoun | 181/157 |
| 7,319,772 | B2 * | 1/2008 | Chang | 381/343 |
| 7,325,650 | B2 * | 2/2008 | Horigome et al. | 181/166 |
| 8,019,112 | B2 * | 9/2011 | Milot et al. | 381/396 |
| 2001/0043713 | A1 * | 11/2001 | Tokusho et al. | 381/398 |
| 2012/0002836 | A1 * | 1/2012 | Milot et al. | 381/398 |

FOREIGN PATENT DOCUMENTS

TW M264793 5/2005

* cited by examiner

*Primary Examiner* — Curtis Kuntz
*Assistant Examiner* — Joshua A Kaufman

(57) ABSTRACT

A loudspeaker has a short support post joined to the forward plate; upper end of the support post in association with the fixing post is joined to the middle part of the drum paper with the fixing post; the voice coil has the upper end thereof joined to the drum paper; when the voice coil drives the drum paper to vibrate and emit sound, the upper end of the short support post sways and generates a small offset because of the lower end of the support post being retained by the forward plate such that the voice coil moves axially in the magnetic clearance without deviation, and the voice coil is incapable of touching the yoke or the forward plate to produce noise; therefore, quality of sound output from the loudspeaker is enhanced effectively.

4 Claims, 2 Drawing Sheets

LOUDSPEAKER

CROSS-REFERENCE TO RELATED APPLICATIONS

The application claims priority from Taiwan Patent Application No. 101221911 filed on Nov. 13, 2012, the disclosure of which is incorporated herein by reference.

BACKGROUND OF THE INVENTION

1. Field of the Invention

The present invention relates to a loudspeaker, and, more particularly, to a loudspeaker which is capable of reducing sway of the voice coil during moving axially so as to enhance quality of the sound output.

2. Description of Related Art

The traditional loudspeaker provides a cylindrical voice coil which moves axially in the magnetic clearance and drives the diaphragm to vibrate and output sound. For instance, the loudspeaker disclosed in U.S. Application Publication No. 20120002836 includes a movable diaphragm, a resilient centering device for centering and guiding the movement of the diaphragm, and a magnet system for controlling the movement of the diaphragm, wherein the diaphragm is positioned between the magnet system and the resilient centering device.

A loudspeaker disclosed in Taiwan Utility Model No. M264793 includes a cone-shaped frame which is integrally formed with a column; the column with an axial through hole faces the opening of the cone; a front piece, a magnet, and a yoke are mounted on the column with a fixing element; the column is surrounded with a centering device and a voice coil; a diaphragm is disposed between the voice coil and the frame.

The fixing element recited in the preceding Taiwan Utility Model has to provide a length enough for extending to the front end of the yoke from the bottom of the frame; when the diaphragm vibrates and emits sounds, the front end of the yoke sways with a large offset to result in the voice coil deviating from the axial movement and distorting the sound output; moreover, it generates noise due to friction cause by the voice coil touching the column or the yoke. In addition, in order to be pierced by the fixing element, the magnet recited in the preceding Taiwan Utility Model No. M264793 provides a through hole, but comparing with the magnet without the through hole, the magnet with the through hole reduces the magnetic performance and degrades quality of the sound output.

SUMMARY OF THE INVENTION

The main objective of the present invention is to provide a loudspeaker in which a short support post is joined to the forward plate; the upper end of the support post in association with the fixing post is joined to the middle part of the diaphragm with the fixing post; the voice coil has the upper end thereof joined to the diaphragm; when the voice coil drives the diagram to vibrate and emit sounds, the upper end of the short support post sways a small offset because of the lower end of the support post being retained by the forward plate such that the voice coil moves axially in the magnetic clearance without deviation, and the voice coil is incapable of touching the yoke or the forward plate to avoid the noise; therefore, the quality of sound output from the loudspeaker is enhanced effectively.

Another object of the present invention is to provide a loudspeaker in which the magnet thereof is provided without the central through hole such that the magnetic performance is stronger than the magnet with the through hole to promote the quality of the sound output from the loudspeaker.

BRIEF DESCRIPTION OF THE DRAWINGS

Further benefits and advantages of the present invention will become apparent after a careful reading of the detailed description with appropriate reference to the accompanying drawings.

DETAILED DESCRIPTION OF THE INVENTION

Figure 1:
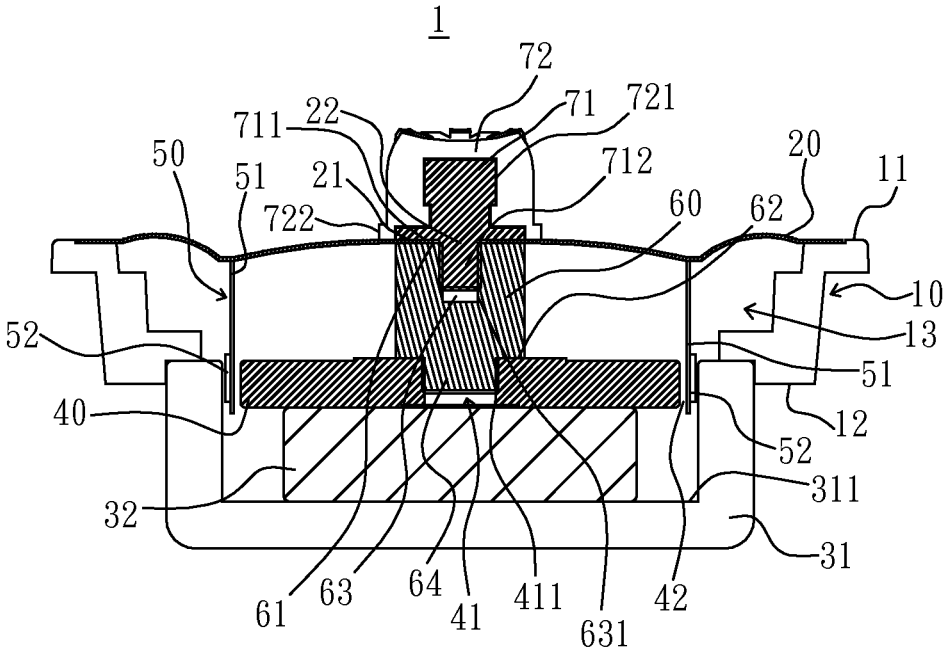
FIG. 1 is a sectional view of the first preferred embodiment of a loudspeaker according to the present invention.

Referring to FIG. 1, the first preferred embodiment of a loudspeaker in accordance with the present invention comprises a frame 10, a diaphragm 20, a yoke 31, a magnet 32, a forward plate 40, a voice coil 50, a support post 60, a fixing post 71, and a dust cover 72.

The frame 10 is basin-shaped with a hollow bottom, and has a first end 11 and a second end 12. The diaphragm 20 has a middle part 21 which further has a through hole 22 at the center thereof. The yoke 31 has a U-shaped cross-section. The forward plate 40 is magnetically permeable.

The fixing post 71 has an enlarged lower end 711 with a first post part 712 extending from the enlarged lower end 711. The support post 60 has a first end 61 disposed with a first groove 63 and a second end 62 disposed with a projection 64 respectively. A second groove 41 is disposed at the center of the forward plate 40. A third groove 721 is disposed at the dust cover 72. The voice coil 50, which can be the conventional voice coil, includes a tubular member 51 and a conductive coil 52 winding around the tubular member 51.

The inner side 311 of the yoke 31 is stacked with a magnet 32, the forward plate 40 and the support post 60 sequentially. The magnet 32 is disposed on and joined to the inner side 311 of the yoke 31; the forward plate 40 is disposed on and joined to the magnet 32. A magnetic clearance 42 is formed between the inner side of the yoke 31 and the outer side of the forward plate 40. An end of the tubular member 51 of the voice coil 50 is joined to the diaphragm 20.

The projection 64 of the support post 60 is joined to the second groove 41 of the forward plate 40 with the conventional way such as adhering or forced tightening. The projection 64 and the groove wall 411 of the second groove 41 both have screw threads corresponding to each other such that the support post 60 is capable of joining with the forward plate 40 as long as the projection 64 engages with the groove wall 411. The first end 61 of the support post 60 is away from the forward plate 40.

The first and second ends 11, 12 of the frame 10 are attached to the diaphragm 20 and the yoke 31 respectively; a space 13 enclosed by the frame 10, diaphragm 20 and the yoke 31 accommodates the magnet 32, the forward plate 40, the voice coil 50 and the support post 60. The forward plate 40 and the support post 60 are disposed inside the voice coil 50.

The first post part 712 of the fixing post 71 passes through the central hole 22 of the diaphragm 20 and is attached to the first groove 63 at the support post 60; the middle part 21 of the diaphragm 20 is fixed between the first end 61 of the support post 60 and the enlarged lower end 711 disposed on the fixing post 71 next to the first post part 712. The third groove 721 at the dust cover 72 fits with the fixing post 71, and a cover bottom 722 of the dust cover 72 presses against the middle part 21 of the diaphragm 20. The dust cover 72 is made of rubber.

The first groove 63 at the support post 60 receives the first post part 71 of the fixing post 71 and is joined to the first post part 71 with the conventional way such as adhering or forced-tightening. The first post part 712 and the groove wall 631 of the first groove 63 have screw threads corresponding to each other such that the support post 71 is capable of engaging with first groove 63.

The conductive coil 52 of the voice coil 50 has an end thereof disposed in the magnetic clearance 42; when the conductive coil 52 in a state of conducting electricity, a magnetic force is generated to interact with a magnetic field formed by the yoke 31, magnet 32 and the forward plate 40 to drive the voice coil 50 and the diaphragm 20 to move back and forth such that the loudspeaker 1 emits sounds.

Due to the bottom of support post 60 being joined to the forward plate 40 and the top of the support post 60 being joined to the middle part 21 of the diaphragm 20 with the fixing post 71, the support post 60 is capable of being arranged with a short length.

The loudspeaker according to the present invention is characterized in that the short support post 60 supports and holds the middle part 21 of the diaphragm 20, and allows the upper end of the voice coil 50 is fixed to the diaphragm 20; when the voice coil 50 drives the diaphragm 20 to vibrate and emit sounds, the upper end of the short support post 60 sways with a small offset so as to lessen deviation of the axial movement of the voice coil 50 because of the lower end thereof being fixedly held by the forward plate 40 such that the sound output from the loudspeaker is less distorted, and the voice coil 50 is incapable of touching the yoke 31 or the forward plate 40, and the noise can be avoided; in addition, the magnet 32, which does not provide a through hole at the center thereof, has stronger magnetic performance than the magnet with the through hole such that the quality of the sound output by the loudspeaker is enhanced advantageously.

Figure 2:
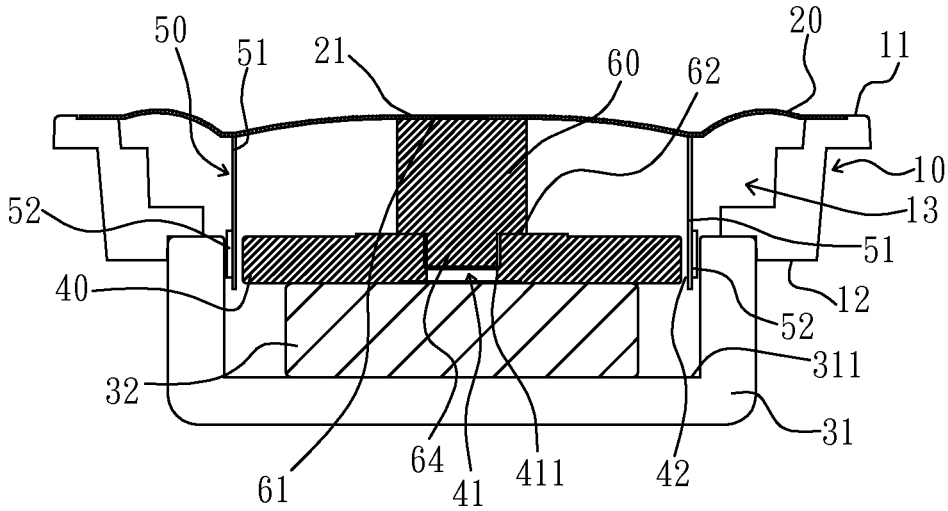
FIG. 2 is a sectional view of the second preferred embodiment according to the present invention.

The dust cover 72 of the loudspeaker according to the present invention can be attached to or not attached to the fixing post 71. As shown in FIG. 2 which illustrates the second embodiment of the present invention, no fixing post and the dust cover are provided, no through hole is provided at the center of middle part 21 of the diaphragm 20, and no groove is provided at the first end 61 of the support post 60; the middle part 21 of the diaphragm 20 is joined to the top of the first end 61 of the support post 60, for instance, the middle part 21 of the diaphragm 20 is adhered to the first end 61 of the support post 60 and supported by the support post 60, and it works as well.

Figure 3:
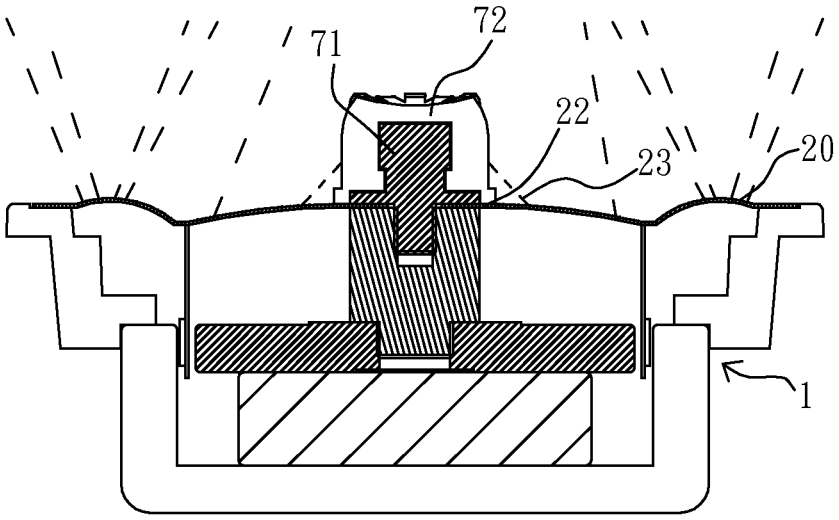
FIG. 3 is a sectional view illustrating sound waves output from the loudspeaker of the present invention being blocked by the dust cover.

As shown in FIG. 3, the fixing post 71 and the dust cover 72 extrude beyond the middle part 22 of the diaphragm 20 such that the sound waves 23, which move toward the fixing post 71 and the dust cover 72 to touch the dust cover 72 or the fixing post 71 (if the fixing post 71 is not joined to the dust cover 72), are blocked and absorbed without interfering other sound waves moving forward via the diaphragm 20; therefore, it occurs a sound equalization effect to promote the quality of the sound output from the loudspeaker.

Although the invention has been explained in relation to its preferred embodiments, it is to be understood that many other possible modifications and variations can be made without departing from the spirit and scope of the invention as hereinafter claimed.

What is claimed is:

1. A loudspeaker comprising:

a basin-shaped frame with a hollow bottom having a first end and a second end;

a diaphragm having a middle part; a yoke with a U-shaped cross-section having an inner side; a magnet disposed on and joined to the inner side of the yoke; a forward plate with magnetic permissibility being disposed on and joined to the magnet, wherein a magnetic clearance is formed between the outer side of the forward plate and the upper inner side of the yoke;

a support post having a first support end and a second support end with the first support end being disposed away from the forward plate and joined to the middle part of the diaphragm and the second support end being joined to the forward plate;

a voice coil having an upper end attached to the diaphragm, accommodating the forward plate and the support post, and 'providing a conductive coil;

wherein the first and second ends of the frame are joined to the diaphragm and the yoke respectively; an inner space is enclosed by the frame, the diaphragm and the yoke to receive the magnet, the forward plate, the voice coil and the support post; an end of the conductive coil is disposed in the magnetic clearance to allow the voice coil without deviating from moving axially and without touching the yoke or the forward plate to avoid noise;

wherein the second support end of the support post has a second post part; a second groove is disposed at the center of the forward plate; the second post part of the support post is engaged to the second groove;

wherein the loudspeaker further comprises a fixing post which has an enlarged lower end and a first post part extending from the enlarged lower end; the first support end of the support post has a first groove; the middle part of the diaphragm has a through hole; the first post part of the fixing part passes through the through hole and engages with the first groove of the support post; the middle part of the diaphragm is held between the enlarged lower end of the fixing post and the first support end of the support post; and wherein the loudspeaker further comprises a dust cover, and a third groove disposed in the dust cover; the third groove fits with the fixing post.

2. The loudspeaker as defined in claim 1, wherein a first groove wall is disposed in the first groove, and the first post part and the first groove wall have screw threads to engage with each other; the second post part and the second groove wall have screw threads to engage with each other.

3. The loudspeaker as defined in claim 2, wherein the bottom of the dust cover presses against the middle part of the diaphragm.

4. The loudspeaker as defined in claim 1, wherein the bottom of the dust cover presses against the middle part of the diaphragm.

* * * * *